United States Patent [19]

Clin et al.

[11] 4,137,155

[45] Jan. 30, 1979

[54] METHOD OF AND APPARATUS FOR PNEUMATICALLY SORTING HETEROGENEOUS MIXTURES

[75] Inventors: François Clin; Jean-Nöel Gony, both of Orleans; François Proust, Olivet, all of France

[73] Assignee: Bureau de Recherches Geologiques et Minieres, Paris Cedex, France

[21] Appl. No.: 791,445

[22] Filed: Apr. 27, 1977

[30] Foreign Application Priority Data

Apr. 27, 1976 [FR] France ..... 76 12437

[51] Int. Cl.[2] ..... B07B 4/02

[52] U.S. Cl. ..... 209/134; 209/149

[58] Field of Search ..... 209/134–137, 209/142, 149, 493, 145, 20, 32–35, 74 R, 146; 198/569, 601, 436, 445, 446

[56] References Cited

U.S. PATENT DOCUMENTS

| | | | |
|---|---|---|---|
| 313,145 | 3/1885 | Willkomm et al. | 209/135 |
| 443,901 | 12/1890 | Craig | 209/142 X |
| 1,549,102 | 8/1925 | Arpin | 209/35 |
| 2,026,910 | 1/1936 | Olsen | 209/137 |
| 3,643,797 | 2/1972 | Berkowitz et al. | 209/135 X |
| 3,738,483 | 6/1973 | Mackenzie | 209/137 X |
| 3,750,882 | 8/1973 | Hays | 209/111.6 |
| 4,018,674 | 4/1977 | Morris | 198/445 X |

FOREIGN PATENT DOCUMENTS

| | | | |
|---|---|---|---|
| 3190 of | 1879 | United Kingdom | 209/135 |

*Primary Examiner*—Ralph J. Hill

*Attorney, Agent, or Firm*—Sughrue, Rothwell, Mion, Zinn and Macpeak

[57] ABSTRACT

A method and apparatus for pneumatically sorting products heterogeneous in nature, form and dimensions, in which the products, while freely falling are deviated by means of a transverse gaseous flux, the height of fall being adjusted before deviation of the products and before production of a second gaseous flux, characterized in that the deviations imparted to the products while freely falling are produced by compressed gases, and their trajectories are determined by the directing of the expansion of the bases between the ejection zone and the atmosphere by means of large panels formed with multiple openings.

3 Claims, 3 Drawing Figures

Fig. 1
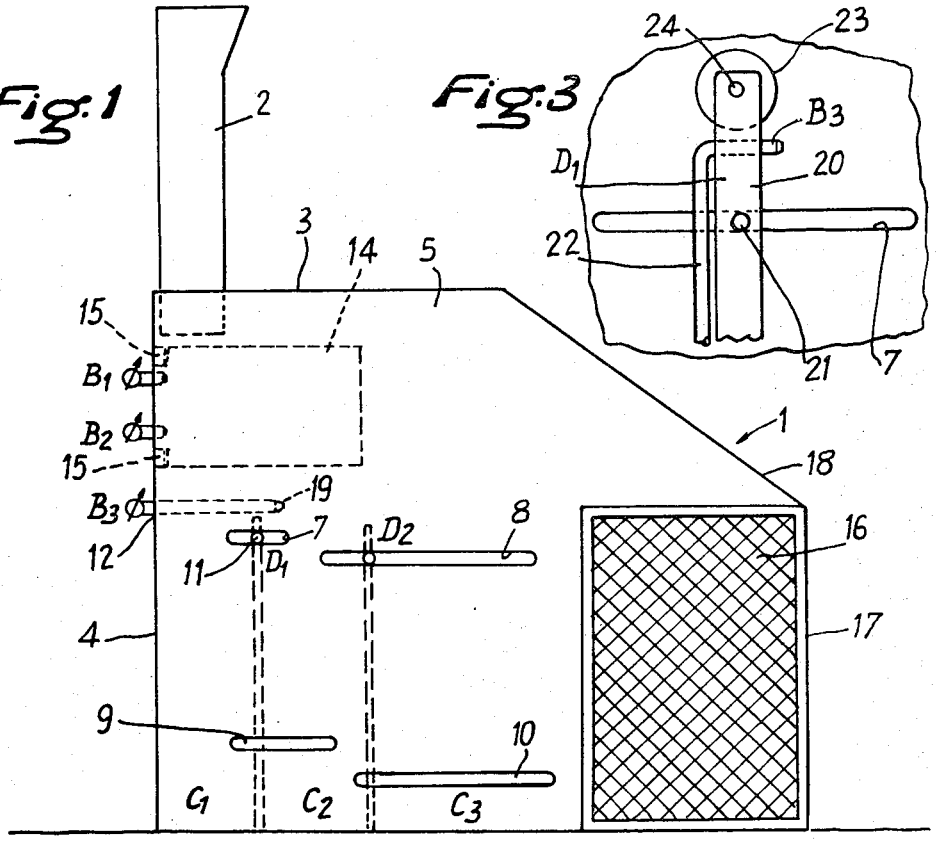
Fig. 3
Fig. 2
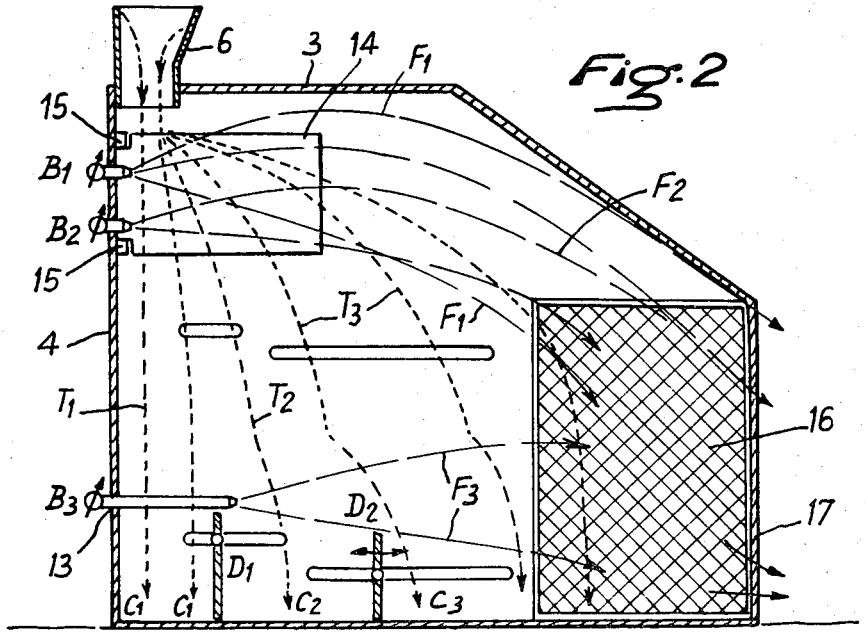

METHOD OF AND APPARATUS FOR PNEUMATICALLY SORTING HETEROGENEOUS MIXTURES

The present invention relates to a sorting apparatus for separating materials which can be as much heterogeneous in nature, dimensions and shape as those to be found in waste refuse.

It is known how to classify owing to a differential exerted by a gaseous flow directed transverse to the direction of free fall on various bodies which are deviated to a greater or lesser extent by the flow, thereby falling in a series of compartments having openings which may be adjusted. Owing to considerable dispersion of the results of such operations both so far as classification accuracy and the trajectories followed by the treated products, the trend has been to treat only products having very similar shapes and dimensions relative to one another.

Thus, apparatus for separating grains of powder products having similar shape and very small dimensions are already known in which separation is carried out at very reduced pressure and uniform speed of the particles and thus an air tight casing is required. Particles are supplied to the apparatus in a horizontal jet and fall into hoppers at the bottom of the air-tight casing, only the finest particles reaching the collection compartments farthest away from where the jet originates. Grain classification is thus obtained but only in the case where the particles have very small dimensions of the order for example smaller than 30 microns.

Apparatus are also known which permit treatment of granular powdery materials having dimensions of the order of 20 microns to 10 mm, separation being effected by means of a gaseous current having a large cross-section so that the granular or powdery material is horizontally conveyed to a greater or lesser extent by large volumes of gas blown at low pressure by a fan.

Obviously in no case can these sorting methods be used for sorting quite different products such as those to be found in waste refuse or in certain industrial waste. On the one hand it is unthinkable to supply products 10 to 200 mm in average size to a very low pressure jet and, on the other hand, it is impossible to separate in a simple manner products flying within a large amount of air which flows horizontally at low pressure. In this case it is even impossible to increase the dimensions of the apparatus to obtain the desired sedimentation because it would be then necessary to considerably increase the usual dimensions and thus reduce the speed of the fluid medium used.

matic sorting method, characterized in that products having greatest different apparent densities are supplied to at least one vertical chute, are then subject to a transverse impulse capable of deviating to a greater or lesser extent all or part of the products being treated, and then allowed to freely fall into a succession of compartments, and that the heights and the partitions of the compartments are adjusted before and after deviation as a function of the apparent densities of the products to be treated.

Thus and contrary to the previous methods, it is then possible to treat with the same apparatus widely different mixtures, for example, from mixed scrap iron having average dimensions of the order of 10 to 200 mm, light iron scrap mixed with heavy iron scrap, to mixtures which can contain papers and cardboards for which there is no need of using successive sorting apparatus of different types or apparatus having prohibiting dimensions.

According to the invention there is also provided a pneumatic sorting apparatus for carrying out the above defined method, comprising a product inlet at its upper part, at least one zone where compressed gas is supplied substantially normally to the side wall downstream of the product feeding device, and a succession of adjustable compartments, characterized in that the feeding chute is adjustable in height or removable, the pressure and thus the speed at which the gas is ejected being adjustable, and that the partitions of the compartments are adjustable in height and position on the base of the apparatus, the gas being discharged, after expansion in the apparatus, downstream of the partitions.

Experience has shown that it is then possible to economically treat with the same apparatus scrap iron of different type: cans, cut up sheets, bulky metal objects, mixtures of paper and cardboards. In the first case, the fall height is decreased before deviation by gas, e.g. compressed air, together with the height of the partitions, the ejection speed of the compressed air being of the order of 200 m/s. In the second case, the fall height is increased before deviation and the height of the partitions is also increased, compressed air being ejected at a speed of the order of 20 m/s. In both cases the speed gradient is always rapidly decreasing.

The apparatus according to the invention is also characterized in that it further comprises a deviation stage located at the same level as the first partition.

This arrangement allows not only classification of products having a close apparent density to be improved but also avoids any sedimentation or comeback of materials drawn onto or close to the partitions.

The invention also provides an apparatus of this type further comprising rollers disposed immediately above the partitions of the classifying compartments so as to avoid products being jammed while they are falling.

Thus, when the paper-cardboard mixture contains scrap, it is possible to force any scrap or any wet falling paper off the upper part of a partition by the rotating roller associated therewith, the ejection force of the compressed air jet also assisting its removal.

The invention will now be described by way of example with reference to the accompanying drawings, in which:

FIG. 1 is a diagrammatic side view illustrating apparatus which is adjusted for treating products having a low apparent density;

FIG. 2 is a cross-sectional view of the adjusted apparatus for treating products having high apparent density, and FIG. 3 is a partial elevational view of the upper end of an adjustable partition.

Apparatus 1 for carrying out the method of sorting heterogeneous products is indicated in FIG. 1 and comprises at its upper part a feed hopper 2 which can be inserted in a suitable seat in the upper wall 3 and rest against any suitable abuttments provided on the inner surface of the end and side walls 4 and 5, these abuttments not being illustrated for clarity. This way of assembling allows a rapid substitution of a hopper 6, FIG. 2, which is shorter than the hopper 2.

The side walls 5, or optionally parallel inner flanges, having adjusting means, e.g. slots 7 to 10, which serve to arrange vertical partitions $D_1$ and $D_2$ to limit compartments C1, C2, C3 in any suitable position.

The slots 7 to 10 together with locking means, for example means comprising bolts or screws as generally indicated by 11, have been chosen only for illustration purposes and clarity of the drawings. However, any adjusting means for the partitions D1 and D2 or for removable mounting can replace the illustrated means.

Moreover, in the illustrated embodiment the wall 4 has two series of bores adapted to locate compressed gas injection nozzles B1 and B2 and two other rows of passages, one of which is indicated by 12 in FIG. 1 and the other by 13 in FIG. 2, for locating removable nozzles B3. The nozzles in a row can be mounted in any manner. In particular, the nozzles B3 are preferably mounted on the same moveable partition within the apparatus as shown in FIG. 3, and generate equidistant impulsive jets along the entire length of the partition. The outlets of the nozzles B1 and B2 are normal to the wall 4.

On both sides of the zones comprising the nozzles B1 and B2, deflectors such as that indicated by 14 are mounted on hinges 15 to pivot about a generally vertical axis. These deflectors on either side of the zones of nozzles B1 and B2 permit the material being sorted to be maintained within the gaseous flow, thereby preventing certain products from being declassed.

A grill 16 is provided at downstream part of the apparatus and extends along the end wall portions 17 and on the downstream parts of the side faces 5. The inclined wall 18 assists, on the one hand, in the directional flow of air or gas streams which expand completely and uniformely owing to the large opening offered by the grill 16 and, on the other hand, in the sedimentation or settling of light products.

Although the above-described apparatus gives excellent results, its operation is further improved in the case where particular products, for example scrap, might get caught on the partitions D1, D2. FIG. 3 illustrates how the device prevents products from being ejected onto the orifices of the nozzles B3. In this embodiment, the nozzles B3 are carried by a member fixed to uprights 20 arranged on either side of the partition D1 which is supported by means 21 with the slots 7 formed in the side wall 5. The group of nozzles B3 is supplied by way of a common duct 22 which extends along the upright 20. A roller 25 can freely rotate about its axis 24 and is supported by the uprights 20. According to a variant, this roller is driven by an auxiliary motor. Thus, each product which normally falls in the compartment C1, FIG. 1, does not impinge against the nozzle B3 and all products which could have blocked the end of the nozzle B3 are stopped by the roller 23. Consequently, even in the case of falling of scrap onto the partition D1, the latter is generally covered by the roller 23, and thus the scrap is immediately ejected into respective compartments C1 or C2. On the other hand, if the product falls on one part or another without unbalancing the roller 23, the jet from the nozzle B3 obliquely unbalances the product on the roller, and thus causes the product generally to fall in C2.

Assume that the products to be classified comprise iron scrap obtained from waste by magnetic separation. These iron scraps may comprise a variety of percentages of thin pieces of sheets from cans, bars, bulky iron scraps, and any other kind of magnetic iron filings in smaller amounts but which have to be sorted despite large differences in their dimensions.

Owing to the relatively large difference in the apparent density of the scrap pieces, use is made of a hopper 6, FIG. 2, having a very short height so as to create vertical dispersion to a small extent without substantially increase the speed of the pieces having a greater apparent density before they enter in the flow of compressed air injected at B1 and B2 as diagrammatically illustrated by the parts upstream of the lines F1 and F2. The height of free fall of the scrap between the base of the hopper and B1 can be of the order of 250 mm.

Since the horizontal speed of the compressed gases is of the order of 200 m/second the whole pieces of scrap iron having a large surface for a given amount of weight are deviated as indicated by the trajectories T2 and T3, the trajectories T1 corresponding to the highest apparent densities. In the illustrated apparatus, the effect of the jet B1 is assisted by the action of the jet B2 so as to increase the horizontal dispersion of the products owing to the large thrust due to the practically simultaneous actions of B1 and B2.

To further increase the horizontal dispersion of the products, the height of fall after the first dispersion has a greater value of the order of 1000 mm so that apart from the products having the highest apparent densities which have been eliminated by following the trajectories T1, only the products having smaller apparent densities and moving along the trajectories T2 and T3 are moved away from one another before the slope of the trajectories takes a too large value. According to the invention, advantage is taken of the new distances obtained during falling of the scrap iron in order to give the products, the speeds of fall of which are lower than those of the products falling along T1, a new thrust or impulsion by means of the flux indicated by the upstream portion of F3 and originating from the nozzle B3. By means of this new impulsion it is thus possible to increase the distance between the products having the lowest apparent densities. In this manner, all the heavy metal objects are collected at C1, all the sheets and thin shavings are collected at C2, whereas all filings are collected at C3.

When the products to be sorted or classified come from waste or refuse having a low apparent density with a high proportion of papers and cardboards, the height of fall is increased before feeding the products to the zone before the jets B1 and B2 where they receive an impulse due to compressed air being ejected from B1 and B2 at a speed of the order of 20 m/second. The height of fall between the upper part of the feeding hopper 2 and B1 is for example of the order of 1000 mm. This distance is sufficient to allow a satisfactory acceleration of the products of highest apparent density to be attained, whereby the products can pass through the jets from B1 and B2 without being considerably deviated so that the products rapidly reach the compartment C1. Conversely, the height of the hopper 6 has the effect of stressing the difference in apparent density by causing the products having the smallest apparent densities to pass rather slowly before the nozzles B1 and B2 the action of which results in a large deviation of these products. To avoid partial grouping of the products owing to resistance to horizontal displacement, the height of fall is reduced after the first deviation due to the impulse from the first jet from B1 so as to rapidly give a new impulse by means of the jet from the nozzle B3 perpendicularly to the partition D1 delimiting the compartments C1 and C2. The height from B1 to B3 after the first deviation is of the order of 350 mm, so that the flux due to the rapid action of B3 downstream of the partition D1 permits maximum dispersion of the treated products depending on their apparent density.

In any case, whether it is a question of heavy products such as scrap iron, or light products such as cardboards or papers, one obtaines an excellent classification of the products even when heavy or light products are mixed with light or heavy products, respectively.

In conclusion and contrary to all the prior methods, the products are treated in at least three steps: a first step comprising free fall of the products, a second step comprising deviation to a greater or lesser extent under the effect of deviation jets, a step of second free fall increasing the horizontal and vertical dispersions of the products as a function of their apparent density, and optionally a final step of horizontal dispersion by means of a jet located at the same level as the first partition separating two adjacent compartments, the height of fall being suitably adjusted depending on the composition of the products to be treated by displacing the jets and by modifying the heights of the partitions.

What we claim is:

1. An apparatus for pneumatically sorting heterogeneous objects of different shapes and densities comprising sorting chamber means having top, side and end walls, open ended vertical hopper means supported on said chamber means and extending through said top wall adjacent one end wall, first air jet means extending through said one end wall in spaced relation to the bottom of said vertical hopper means for directing at least one horizontal jet of air toward the other end wall across the open bottom of said hopper means, outlet means in said chamber adjacent the lower end of said other end wall, at least one vertical partition extending between said side walls to define a plurality of bins, mounting means for adjustably and removably securing each partition to said side walls at selected locations intermediate said end walls and second jet means mounted on the top of the partition closest to said one end wall and spaced below said first jet means for directing a horizontal jet of air toward said other end wall to impart a further lateral impulse to those objects which were previously diverted by said first jet means from their vertical downward path as they emerged from said vertical hopper means, roller means rotatably mounted parallel to the top of said partition above said second jet means to prevent falling objects from lodging on top of said partition and interfering with said second jet means and two deflectors mounted on said one end wall for rotation about vertical axes on opposite sides of said first jet means for laterally containing the expansion of the air jets carrying the objects to be sorted.

2. An apparatus as set forth in claim 1 wherein said first jet means is comprised of two horizontal rows of air jets vertically spaced from each other.

3. An apparatus as set forth in claim 2 wherein said other end wall is comprised of an upper portion opposite from and inclined toward said first jet means and a lower portion having outlet means therein whereby said air jets from said first jet means will expand and be diverted downwardly toward said outlet means by said inclined upper portion of said other end wall.

* * * * *